US006101935A

United States Patent [19]

Ohkawa

[11] Patent Number: 6,101,935

[45] Date of Patent: Aug. 15, 2000

[54] PRESS DRUM A STENCIL PRINTER

[75] Inventor: Eiji Ohkawa, Watari-gun, Japan

[73] Assignee: Tohoku Ricoh Co., Ltd., Shibata-gun, Japan

[21] Appl. No.: 09/130,518

[22] Filed: Aug. 7, 1998

[30] Foreign Application Priority Data

Dec. 8, 1997 [JP] Japan ..... 9-336960
May 22, 1998 [JP] Japan ..... 10-141537

[51] Int. Cl.[7] ..... B41L 13/06
[52] U.S. Cl. ..... 101/116; 101/119
[58] Field of Search ..... 101/116, 119, 101/376, 216, 217

[56] References Cited

U.S. PATENT DOCUMENTS 4,076,867 2/1978 Lewiciki et al. ..... 427/264
5,373,785 12/1994 Yamamato et al. ..... 101/116
5,724,888 3/1998 Okuda et al. ..... 101/116
5,768,990 6/1998 Vrotacoe et al. ..... 101/217
5,878,660 3/1999 Takahashi et al. ..... 101/116

*Primary Examiner*—John S. Hilten
*Assistant Examiner*—Daniel J. Colilla
*Attorney, Agent, or Firm*—Oblon, Spivak, McClelland, Maier & Neustadt, P.C.

[57] ABSTRACT

A press roller for a stencil printer of the present invention is rotatable while pressing a recording medium against an ink drum which is rotatable with a master wrapped therearound. The press drum includes a hollow cylinder and an elastic layer formed on the outer periphery of the hollow cylinder. The elastic layer has a higher compressibility than a recording medium and performs, when compressed, elastic deformation in place of bulk movement. With this configuration, the press drum protects the master from damage ascribable to the localization of a pressing force. In addition, the press drum prevents a recording medium from creasing due to a difference in linear velocity otherwise occurring between the press drum and the recording medium at a pressing position.

12 Claims, 10 Drawing Sheets

PRESS DRUM A STENCIL PRINTER

BACKGROUND OF THE INVENTION

The present invention relates to a stencil printer and more particularly to a press drum included in a stencil printer.

A stencil printer including a rotatable ink drum and a rotatable hollow cylindrical press drum is conventional. While the ink drum is rotated with a master wrapped therearound, the press drum is rotated while pressing consecutive papers against the ink drum one by one. As a result, ink fed from ink feeding means is transferred to each paper in order to print an image thereon.

Usually, the press drum has substantially the same diameter as the ink drum and is driven to rotate at the same speed as the ink drum. A recess is formed in a part of the outer periphery of the press drum in the axial direction of the press drum. Clamping means for clamping the leading edge of a paper or similar recording medium is positioned in the recess. A master clamper for clamping a master is mounted on the ink drum. The recess is positioned in relation to the master clamper so as to prevent the press drum from interfering with the master clamper and to reduce the displacement of the press drum and therefore noise when the press drum is pressed against the ink drum. The press drum conveys a paper with the clamping means clamping the leading edge of the paper. This prevents the paper being discharged from curling and enhances accurate registration.

One of conventional press drums includes an aluminum molding formed by extrusion molding and having a partly removed circular section. A rubber layer or elastic layer is formed on the outer periphery of the molding and has its periphery ground. The rubber layer is made as thin as, e.g., 3 mm to 5 mm in order to reduce the weight of the press drum. Therefore, even if rubber constituting the rubber layer has a rubber hardness of HS20 as prescribed by JIS-A, the layer deforms to a degree corresponding to a rubber hardness of HS40 as also prescribed by JIS-A due to its thinness. This is because the rubber layer is too thin to exhibit its elasticity corresponding to the hardness selected. For example, assume that images are printed on envelopes. Then, when images are continuously printed on several hundred envelopes, a master tears in its portions corresponding to the comparatively thick portions of the envelopes. As a result, ink deposits on and smears the successive envelopes via the torn portions of the master.

In light of the above, the hardness of the rubber layer may be reduced in order to reduce the concentration of a pressing force on the comparatively thick portions of a paper. This kind of scheme, however, causes the rubber layer to perform bulk movement to both sides of a paper. As a result, the distance between the center of the press drum and a pressing position becomes equal to the sum of the radius of the press drum and the thickness of the paper and therefore greater than the distance between the center of the ink drum and the pressing portion, as will be described specifically later. Consequently, the paper moves at a higher linear velocity than the periphery of the ink drum, as seen at the printing position, causing the master to crease.

Technologies relating to the present invention are also disclosed in, e.g., Japanese Patent Laid-Open Publication Nos. 5-330225, 8-332769, 9-1914, 9-216448 and 8-58216 as well as in U.S. Pat. No. 4,911,069.

SUMMARY OF THE INVENTION

It is therefore an object of the present invention to provide a press drum for a stencil printer capable of protecting a master from damage ascribable to the local concentration of a pressing force and preventing the master from creasing due to a difference in linear velocity otherwise occurring between an ink drum and a paper at a pressing portion.

A press drum for a stencil printer of the present invention includes a hollow cylinder constituting a base and rotatable while pressing a recording medium against an ink drum which is rotatable with a master wrapped therearound. An elastic layer is formed on the outer periphery of the hollow cylinder and has a higher compressibility than the recording medium. The elastic layer performs elastic deformation in place of bulk movement when compressed.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
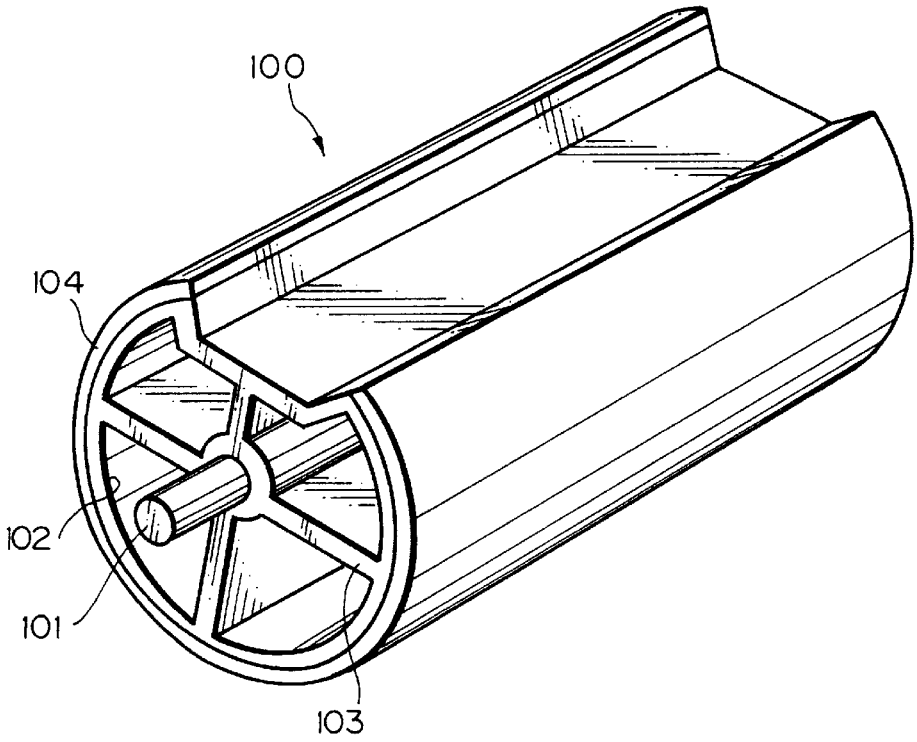
Fig. 1 PRIOR ART
FIG. 1 is a perspective view showing a conventional press drum.

To better understand the present invention, brief reference will be made to a conventional press drum for a stencil printer, shown in FIG. 1. As shown, the press drum, generally 100, includes an aluminum molding 102 formed by extrusion molding and having a partly removed circular section. A rubber layer or elastic layer 104 is formed on the outer periphery of the molding 102 and has its periphery ground. For the rubber layer 104, use is generally made of nitrile rubber. Cruciform ribs 103 are formed in the molding 102 in order to reinforce the molding 102. A shaft 101 extends throughout the molding 102 at the center of the molding, i.e., a position where the ribs 103 intersect each other. Another conventional press drum is produced by cutting off an aluminum molding and then grinding the outer periphery thereof.

Figure 2:
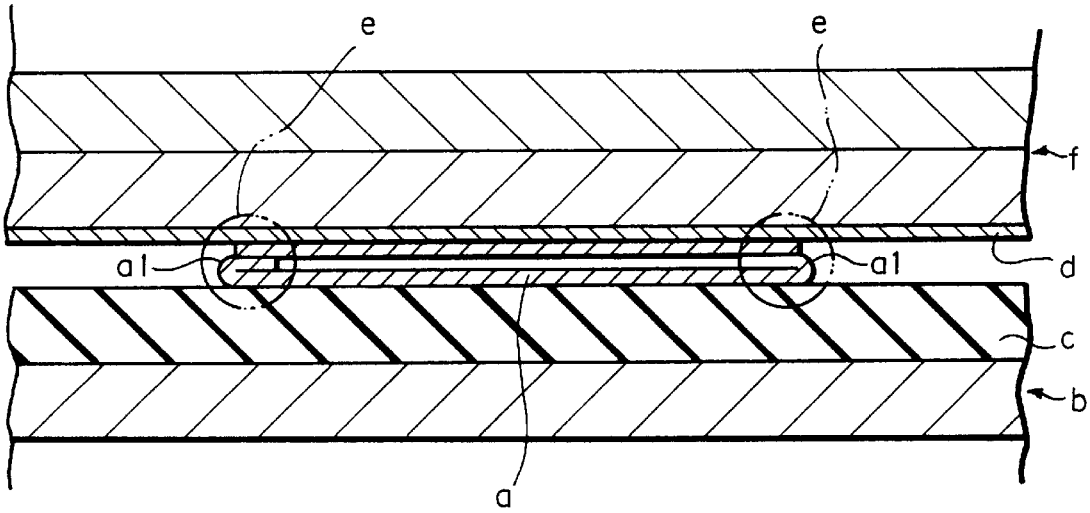
Fig. 2 PRIOR ART
FIG. 2 is fragmentary enlarged section of a pressing position where the press drum of FIG. 1 and an ink drum print an image on a paper including folded portions.
Figure 3:
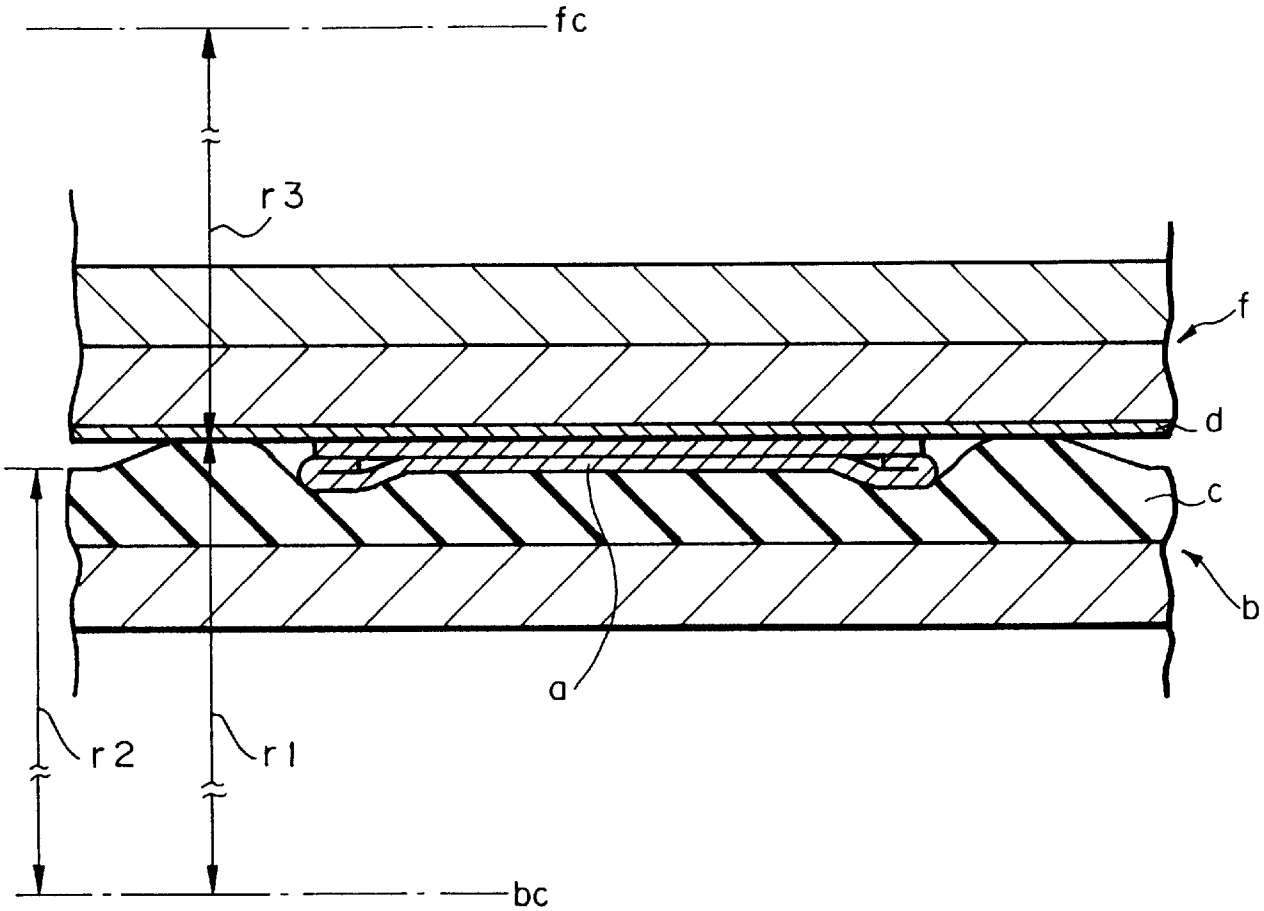
Fig. 3 PRIOR ART
FIG. 3 is a view similar to FIG. 2, showing a case wherein a rubber layer formed on the press drum has its hardness reduced.

The rubber layer 104 of the press drum 100 is made as thin as, e.g., 3 mm to 5 mm in order to reduce the weight of the press drum 100, as stated earlier. Therefore, even if rubber constituting the rubber layer 104 has the previously mentioned rubber hardness of HS20, the layer 104 deforms to a degree corresponding to a rubber hardness of HS40 due to its thinness. This is because the rubber layer is too thin to exhibit its elasticity corresponding to hardness selected. As shown in FIG. 2, assume an image is printed on an envelope or similar paper a including folded portions a1 which are thicker than the other portion. Then, the pressing force of a press drum b concentrates on the folded portions a1 due to the high hardness of a rubber layer c included in the press drum b. As a result, the pressing force also concentrates on the portions (labeled e) of a master d corresponding to the folded portions a1. Labeled f in FIG. 2 is an ink drum. When images are continuously printed on several hundred envelopes, the master d tears in its portions e. As a result, ink deposits on and smears the successive envelopes via the torn portions of the master d.

In light of the above, the hardness of the rubber layer c may be reduced in order to reduce the concentration of the pressing force on the comparatively thick portions of the paper a. This kind of scheme, however, causes the rubber layer c to perform bulk movement to both sides of a paper. As a result, a distance r1 between the center bc of the press drum b and the pressing portion becomes greater than the radius r2 of the press drum b or becomes greater than the distance r2 by the thickness of the paper a. More specifically, the distance r1 becomes greater than the distance between the center fc of the ink drum f and the pressing position, i.e., the radius r3 of the ink drum f. This also occurs when images are printed on relatively thick papers. As a result, the distance between the center of the press drum and a pressing position becomes equal to the sum of the radius of the press drum and the thickness of the paper and therefore greater than the distance between the center of the ink drum and the pressing portion. Consequently, the paper moves at a higher linear velocity than the periphery of the ink drum, as seen at the printing position, causing the master to crease.

Preferred embodiments of the press drum for a stencil printer in accordance with the present invention will be described hereinafter. First, a stencil printer to which the illustrative embodiments are applicable will be described.

Figure 4:
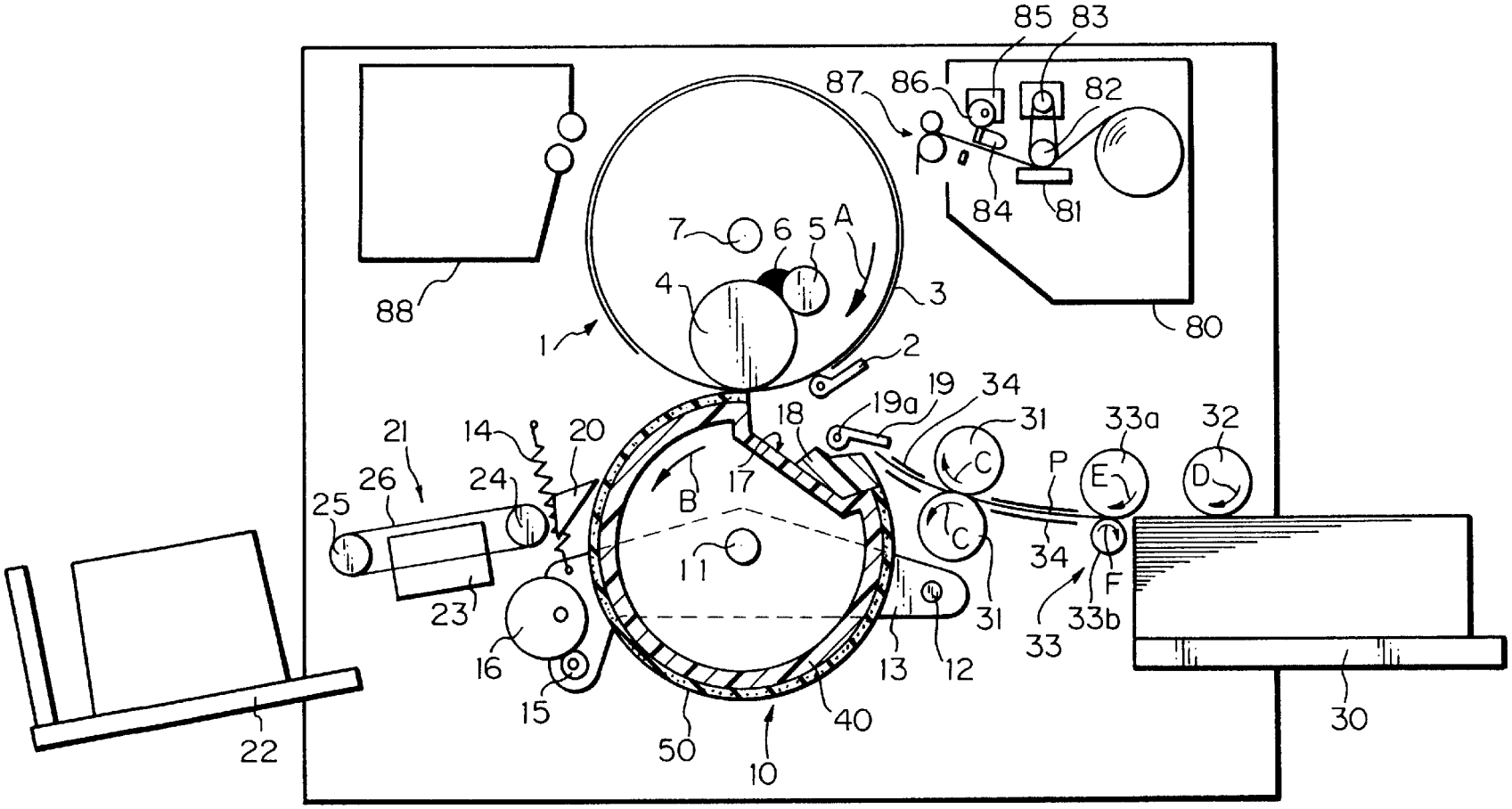
FIG. 4 shows the general construction of a stencil printer to which the present invention is applicable.

As shown in FIG. 4, the stencil printer includes an ink drum 1 including a porous hollow cylinder covered around which a mesh screen is wrapped. A master clamper 2 is mounted on the outer periphery of the ink drum 1 and rotatable about a line parallel to the axis of the drum 1. A mechanism, not shown, causes the master clamper 2 to open and close at a preselected position. A master 3 has its one end clamped by the master clamper 2 and has its other end wrapped around the ink drum 1.

A master making device 80 is positioned at the right-hand side of the ink drum 1, as viewed in FIG. 4. The master making device 80 perforates a stencil, also labeled 3, in accordance with image data representative of a document so as to produce the master 3. Specifically, a thermal head 81 perforates the stencil 3 in accordance with the image data. A platen roller 82 conveys the stencil 3 while pressing it against heating elements arranged on the head 81. A pulse motor 83 is drivably connected to the platen roller 82. A cutter 84 cuts away the perforated part of the stencil, i.e., the master 3 by being driven by a motor 85. An eccentric cam 86 determines the timing for the cutter 84 to cut away the master 3. A pair of master feed rollers 87 guide the leading edge of the master 3 to the master clamper 2. The stencil 3 is loaded in the device 80 in the form of a roll. A master discharging device 88 is located at the left-hand side of the ink drum 1, as viewed in FIG. 4, for removing a used master 3 from the ink drum 1 and discharging it.

The ink drum 1 is rotated clockwise by a drive mechanism, not shown, as indicated by an arrow A in FIG. 4. An ink roller 4 is disposed in the ink drum 1 and rotatable in synchronism with and in the same direction as the ink drum 1. A doctor roller 5 is also disposed in the ink drum 1 and spaced from the ink roller 4 by a small gap, forming a wedge-shaped ink well 6 between it and the ink roller 4. Ink is fed to the ink well 6 via holes formed in a shaft or pipe 7. The ink roller 4 conveys the ink from the ink well 6 to the inner periphery of the drum 1 which is slightly spaced from the periphery of the ink roller 4.

A press roller 10 representative of a first embodiment of the present invention is positioned below the ink drum 1 in such a manner as to face the ink roller 4. The press drum 10 has substantially the same diameter as the ink drum 1. The press drum 10 mainly consists of a base or body 40, a shaft 11 supporting the drum 10, and an elastic layer 50 formed on the outer periphery of the base 40. The base 40 and elastic layer 50 will be described in detail later.

A recess 17 is formed in a part of the outer periphery of the press drum 10 and extends in the axial direction of the drum 10. The recess 17 prevents the press drum 10 from colliding with the master clamper 2 of the ink drum 1. A clamper base 18 is positioned in the recess 17 and formed of synthetic resin. A paper clamper 19 is mounted on the clamper base 18 for retaining the leading edge of a paper P which is a specific form of a recording medium. The paper clamper 19 is rotatably supported by a shaft 19*a*. The paper clamper 19 is caused to open at a preselected timing by a cam, not shown, clamp the paper P, and then close in order to retain the paper P on the press drum 10. On reaching a position where a peeler 20 is located, the paper clamper 19 is caused to open and release the paper P. The paper P released from the paper clamper 19 is fed to a paper conveyor 21.

The press drum 10 is connected to the ink drum 1 by an endless belt such that the drum 10 is pressed against the drum 1 at the same position at each time of rotation. The press drum 10 is rotatable counterclockwise, as indicated by an arrow B in FIG. 4.

The shaft 11 of the press drum 10 is supported by a pair of arms 13 (only one is visible) which are rotatable about a shaft or fulcrum 12. The press drum 10 is therefore movable into and out of contact with the ink drum 1 in accordance with the angular movement of the arms 13. A spring 14 is anchored at one end to one side wall of the printer and at the other end to the free end of the associated arm 13. The spring 14 constantly biases the arm 13 such that the press drum 10 tends to contact the ink drum 1. A cam follower 15 is mounted on the free end of the arm 13 and held in contact with a cam 16. The cam 16 controls the angular movement of the arm 13, i.e., the pressure for pressing the press drum 10 against the ink drum 1.

Further, the cam 16 is rotatable in synchronism with the ink drum 1 in order to release the press drum 10 from the ink drum 1 at a preselected timing. This is a measure for coping with the defective conveyance of the paper P. If the conveyance of the paper P is not defective, the press drum 10 retaining the paper P thereon is again pressed against the ink drum 1 due to the action of the spring 14. If the conveyance is defective, then a pressure cancelling mechanism, not shown, cancels the pressure in order to prevent the press drum 10 from contacting the ink drum 1.

An elevatable paper tray 30 loaded with a stack of papers P and a pair of feed rollers 31 are arranged below and at the right-hand side of the ink drum 1, as viewed in FIG. 4. The feed rollers 31 each is rotatable in a direction indicated by an arrow C in order to feed the paper P to the press drum 10. The paper tray 30 is elevatable such that the top of the paper stack constantly contacts a pick-up roller 32 with a pressure lying in an adequate range, i.e., a range allowing the top paper P to be fed out.

A separator roller 33 is interposed between the paper tray 30 and the feed rollers 31 in order to prevent two or more papers P from being fed together. The separator roller 33 is made up of a feed roller 33*a* for feeding the top paper P from the paper tray 30 to the feed rollers 31, and a reverse roller 33*b* positioned below the feed roller 33*a* for returning the papers P other than the top paper P to the tray 30. A guide 34 extends between the reverse roller 33 and the feed rollers 31 for guiding the paper P to the nip between the feed rollers 31. Also, a guide 34 extends from the feed rollers 31 toward the paper clamper 19 for guiding the paper P.

The pick-up roller 32, feed roller 33*a* and reverse roller 33*b* are respectively rotatable in directions indicated by arrows D, E and F. The paper tray 30, feed rollers 31, pick-up roller 32 and separator roller 33 constitute paper feeding means in combination.

The peeler 20 mentioned earlier peels off the paper P carrying an image thereon, i.e., a printing from the press drum 10. The paper conveyor 21 also mentioned earlier conveys the printing P to a tray 22. The peeler 20, paper conveyor 21 and tray 22 are arranged below and at the left-hand side of the ink drum 1, as viewed in FIG. 4. The paper conveyor 21 includes a fan 23 for sucking the rear of the paper P, a pair of rollers 24 and 25, and a belt 26 passed over the rollers 34 and 25.

In operation, a used master 3 wrapped around the ink drum 1 is peeled off from the drum 1 and then discharged into the master discharging device 88. In the master making device 80, the thermal head 81 perforates the stencil 3 in accordance with an image signal output from a scanner not shown. The perforated part of the stencil 3 is conveyed toward the ink drum 1 by the platen roller 82 until the leading edge of the stencil 3 has been clamped by the master damper 2. When the ink drum 1 is rotated in the direction A, and the stencil 3 is paid out by a preselected amount, the motor 85 drives the cutter 84 via the eccentric cam 86. As a result, the cutter 84 cuts away the perforated part of the stencil 3, i.e., the master 3. When the master 3 is fully wrapped around the ink drum 1, the master making and feeding operation ends.

The top paper P on the paper tray 30 is picked up by the pick-up roller 32 and then fed to the feed rollers 31 by the feed roller 33*a* while being separated from the underlying papers P by the reverse roller 33*b*. The feed rollers 31 convey the paper P toward the ink drum 10. At this time, the paper clamper 19 on the press drum 10 is caused to open, catch the paper P, and then close to clamp the paper P. The press drum 10 continuously rotates to convey the paper P retained thereon toward the nip between the ink drum 1 and the press drum 10.

In FIG. 4, the press drum 10 is pressed against the ink drum 1 at the nip due to the action of the spring 14, so that the paper P is pressed against the drum 1. At this instant, the ink fed to the inner periphery of the ink drum 1 by the ink roller 4 is transferred to the paper P via the perforations of the master 3 wrapped around the drum 1, printing a document image on the paper P. As the press drum 10 is further rotated, the paper clamper 19 is caused to open and release the paper or printing P at a position short of the peeler 20. As a result, the printing P is peeled off by the peeler 20 and then conveyed by the paper conveyor 21 to the tray 22.

The press drum 10 will be described more specifically with reference to FIGS. 5 and 6. As shown, the base or body 40 is implemented as a bottomed hollow cylinder having a bottom wall 40*a* at one end, i.e., a cup-like hollow cylinder. A disk-like flange 41 is adhered to the other end or open end of the base 40. The base 40 and flange 41 are formed of phenol resin or similar thermosetting synthetic resin and molded integrally with each other. Thermosetting synthetic resin looses its plasticity when heated and turns out a rigid body. Thermoplastic synthetic resin has a smaller coefficient of thermal expansion and greater strength than thermoplastic resin and is capable of forming a thick wall with little deformation.

The base 40 implemented as a single molding of thermosetting synthetic resin does not need any rib thereinside and is therefore lower in weight than the conventional aluminum molding produced by extrusion molding. Further, the base 40 has greater rigidity than the conventional aluminum molding. In addition, the combination of the cup-like hollow cylinder and flange 41 affixed to the open end of the cylinder enhance the strength of the press drum 10.

The shaft 11 extends throughout the bottom wall 40*b* and flange 41 at the center of the base 40. The shaft 11 is affixed to the bottom wall 40*a* by a pin 42. A ball bearing 43 is press-fitted on one end of the shaft 11 protruding from the bottom wall 40*a*. Another ball bearing 43 is press-fitted on the other end of the shaft 11 protruding from the flange 41. A pulley 44 is affixed to the end of the shaft 11 protruding from the bottom wall 40*a*. The ball bearings 43 each is affixed to the respective arm 13. In this configuration, the press drum 10 is rotatably supported by the arms 13. The endless belt mentioned previously is passed over the pulley 44.

The elastic layer 50 is implemented by a sponge-like sheet of single foam, urethane foam having a small residual compression strain. The sheet has a higher compressibility than the paper P. Particularly, when the paper P is in the form of an envelope including folded portions, i.e., when an image is to be printed on an envelope, use is made of a sheet having a higher compressibility than the folded portions of the envelope. The sheet has a low density.

In the illustrative embodiment, for the elastic layer 50, use is made of POLON L-24 available from Inoak Corporation. POLON L-24 is an urethane microcell foam body and is implemented as a sponge-like sheet including a number of independent cells. This sheet has a higher compressibility than the folded portions of an envelope. The independent cells have diameters as small as 10 $\mu$m to 200 $\mu$m. Even when the ink deposits on the elastic layer 50, the independent cells prevent the ink from penetrating into the elastic layer 50. In addition, because the sponge-like sheet has a far smaller specific gravity than a rubber sheet, it contributes to the reduction of the weight of the press drum 10. This is particular true when the press drum 10 has a relatively great diameter.

Table 1 shown below lists data comparing POLON L-24 and conventional nitrile rubber.

TABLE 1

| Item | Unit | Property Values | | |
|---|---|---|---|---|
| | | Nitrile Rubber | Polon L-24 | Testing Method |
| Density | $g/cm^3$ | 1.36 | 0.24 | |
| Tensile Strength | $N/m^2$ | $9.8 \times 10^6$ | $0.27 \times 10^6$ | JIS-K-6301 |
| Tear Strength | KN/m | 20 | 1.2 | JIS-K-6301 |
| Elongation | % | 700 | 100 | JIS-K-6301 |
| Residual Compression Strain | % | 20~40 | below 10 inclusive | JIS-K-6401 (70° C. × 22 h) |
| Hardness | | 85~87 | 35~37 | SRIS0101 (Japan Rubber Association Standard) |

Figure 7:
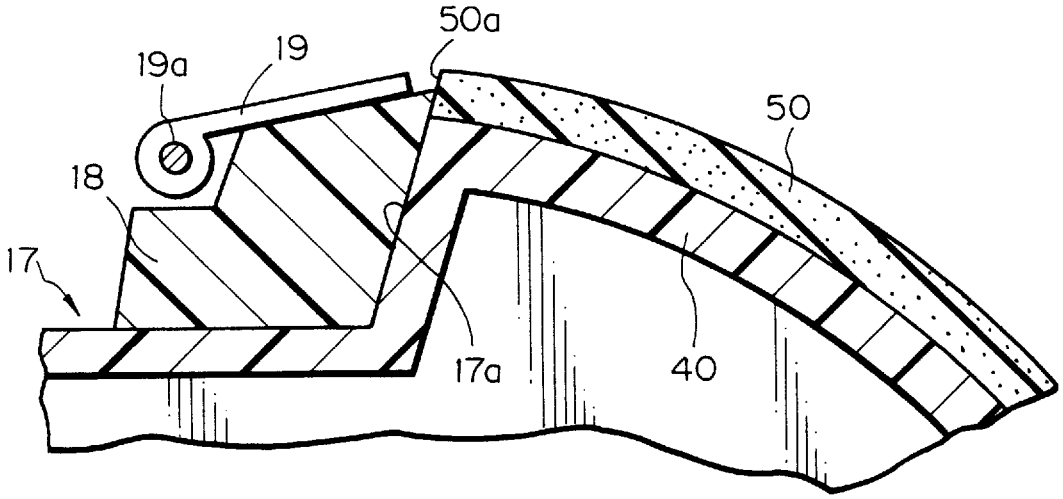
FIG. 7 is a fragmentary enlarged section showing a part of the press drum of FIG. 5 where a clamper base is mounted.

The elastic layer 50 is adhered to the outer periphery of the base 40 except for the recess 17, i.e., the arcuate portion of the base 40 by two-sided adhesive tapes. As shown in FIG. 7, the end face 50*a* of the elastic layer 50 is substantially flush with the edge 17*a* of the recess 17.

Figure 18:
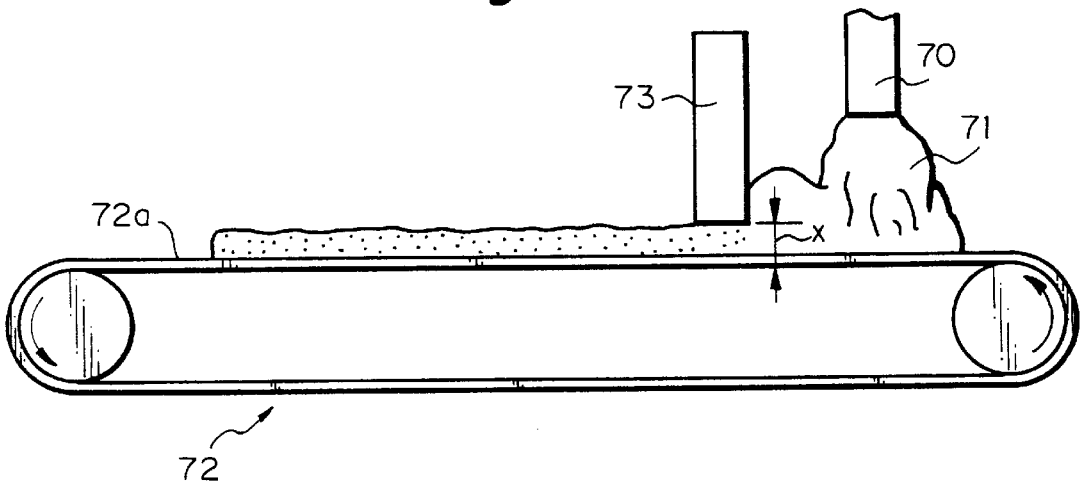
FIG. 18 shows an arrangement for producing POLON L-24 (trade name)

How POLON L-24 is produced will be described with reference to FIG. 18. As shown, urethane foam 71 is fed from a nozzle 70 to a belt conveyor 72. While the belt conveyor 72 conveys the urethane foam 71, a squeegee 73 regulates the thickness of the urethane foam 71. The conveying surface 72*a* of the conveyor 72 and the end of the squeegee 72 are spaced by a gap x greater than the thickness of the elastic layer 50. While passing though the gap x, the urethane foam 71 automatically foams without resorting heat and turns out a microcell foam body having numerous independent cells therein.

However, the problem with the above procedure is that a mold or similar member for restricting the surface of the urethane foam 71 is absent at a position downstream of the squeegee 73 in the direction of conveyance. As a result, despite the function assigned to the squeegee 73, the thickness of the urethane foam 71 is scattered in the range of ±0.3 mm due to automatic foaming. If the scatter is noticeable, particularly if dimples are formed in the surface of the urethane foam 71, then the pressure decreases in the portion where the dimples are present, resulting in low image density.

Figure 19:
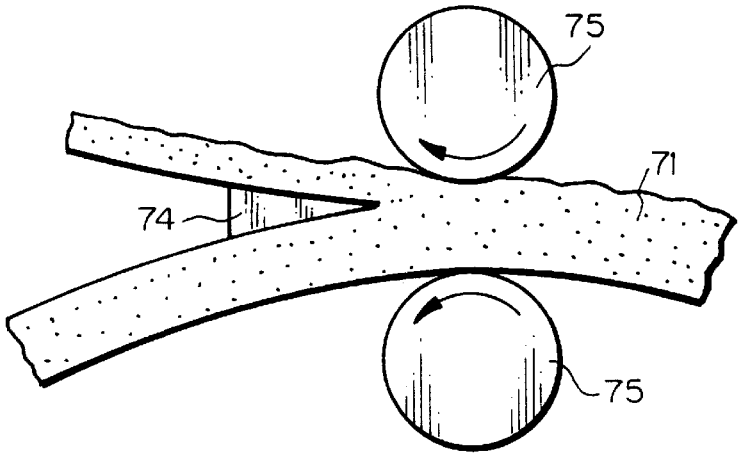
FIG. 19 is a fragmentary view showing how a knife included in the arrangement of FIG. 18 shaves the surface of urethane foam.

In light of the above, as shown in FIG. 19, an knife 74 shaves the surface of the urethane foam 71 so as to provide the urethane foam 71 with a flat surface. The flat surface obviates irregular image density. Although the surface of the urethane foam 71 contacting the conveying surface 72*a* may foam, it is free from irregularities because the conveying surface 72*a* is smooth. In FIG. 19, an upper and a lower roller 75 nip the urethane foam 71 therebetween and drive it toward the edge 74.

Figure 5:
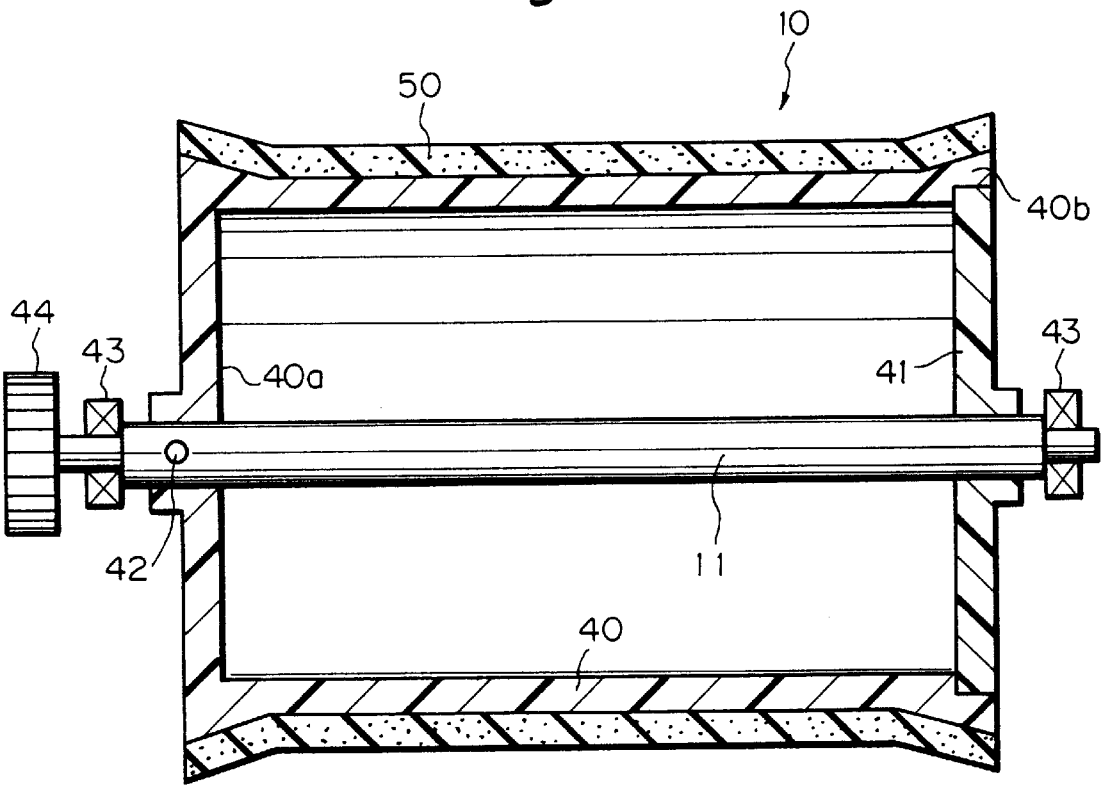
FIG. 5 is an axial section showing a first embodiment of the press drum in accordance with the present invention.
Figure 6:
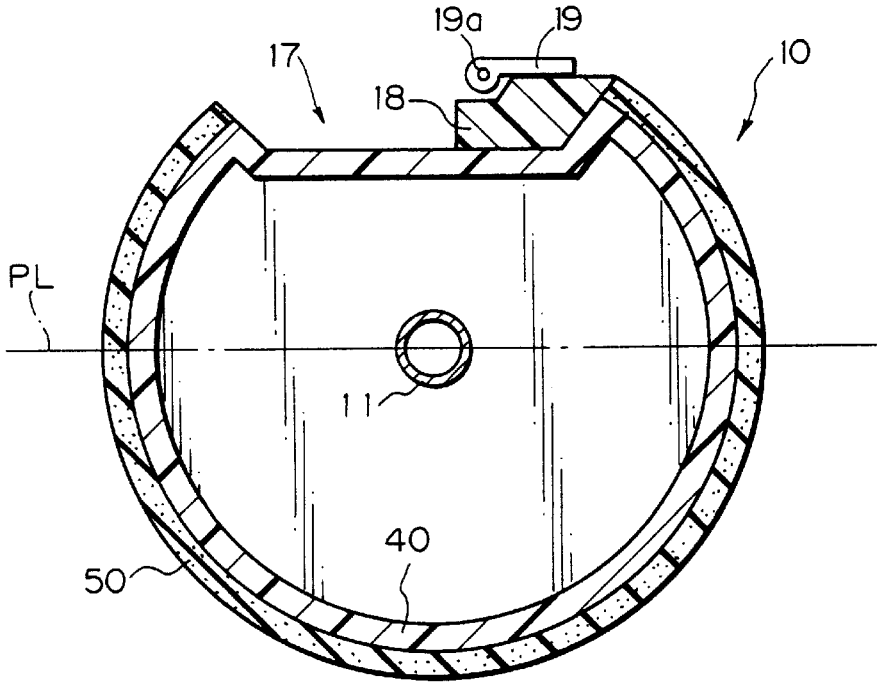
FIG. 6 is a cross-section of the press drum shown in FIG. 5.
Figure 8:
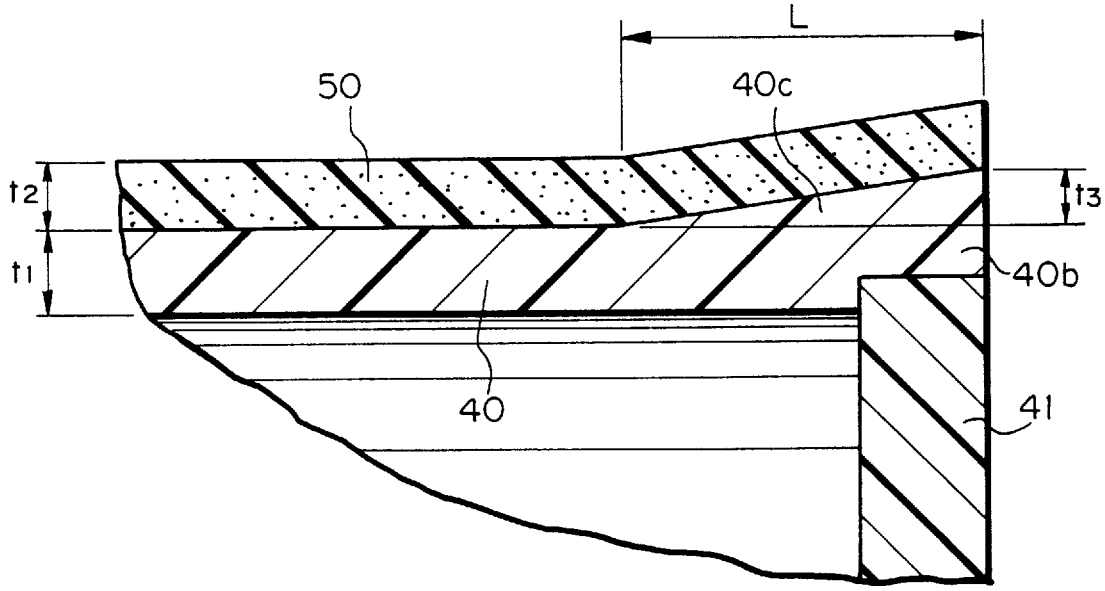
FIG. 8 is a fragmentary enlarged section showing one end portion of the press drum of FIG. 5.

As shown in FIGS. 5 and 8, the outer periphery of the base 40 is flared axially outward, or tapered axially inward, at the bottom wall 40*a* and open end 40*b*, forming flared portions 40*c*. That is, the flared portions 40*c* each sequentially increases in diameter from the intermediate portion to the end of the base 40. The elastic layer 50 is adhered to the outer periphery of the base 40 along such flared portions 40*c*. Stated another way, the opposite ends of the elastic layer 50 are also flared axially outward from the intermediate portion to the ends of the base 40.

In the above configuration, the thickness of the base 40 sequentially increases from the intermediate portion toward the opposite ends, so that the outside diameter of the press drum 10 sequentially increases from the intermediate portion to the opposite end portions. When the press drum 10 is pressed against the ink drum 1, the elastic layer 50 is compressed more at the opposite end portions than at the intermediate portion. Hardness therefore increases at the opposite end portions of the elastic layer 50 and thereby enhances the rigidity of the press drum 10 there. During low temperature printing or high speed printing, it is likely that the rigidity of the press drum 10 becomes short at the opposite ends and causes the opposite ends to deform. This reduces the printing pressure and thereby causes the opposite ends of an image to be blurred or partly omitted in the widthwise direction of the paper P. In the illustrative embodiment, the enhanced rigidity of the opposite ends of the press drum 10 insures a desired printing pressure over the entire area of an image, so that the image is free from blurring or local omission.

FIG. 8 shows specific dimensions of the press drum 10. As shown, the intermediate portion of the base 40 has a thickness t1 between 3 mm and 5 mm. The elastic layer 50 has a thickness t2 between 3 mm and 6 mm. In this condition, the flared portions 40*c* each has a length L between 10 mm and 30 mm in the axial direction of the base 40. The thickness of the base 40 is greater at the bottom wall 40*a* and open end 40*b* than at the intermediate portion by t3, determining the slope of each flared portion 40*c*. The thickness t3 is selected to be 0.5 mm to 0.7 mm.

A procedure for producing the press drum 10 is as follows. To produce the base, use is made of a pair of metal molds. Specifically, as shown in FIG. 6, assume that the base 40 is separated by a parting line PL. Then, one metal mold is allotted to the portion of the base 40 above the line PL and including the recess 17, while the other metal mold is allotted to the portion of the base 40 below the line PL. The line PL extends through the axis of the press drum 10 and divides the drum 10 in the axial direction.

Phenol resin or similar thermosetting resin is introduced into the two metal molds and then heated and pressed. As a result, the resin is cured to form a cup-like hollow cylindrical molding constituting the base 40. In another step, the flange 41 is also molded by use of phenol resin. The flange 41 is adhered to the open end 40*b* of the base 40, completing the hollow cylindrical base 40.

The shaft 11 is inserted into the base 40 such that it extends throughout the bottom wall 40*a* and flange 41 at the center of the base 40. Then, the shaft 11 is affixed to the bottom wall 40*a* by the pin 42. Subsequently, while the base 40 is rotated with its shaft 11 supported, its outer periphery is ground by a cylinder grinding machine. As a result, the flared portions 40*c* are formed at the opposite ends of the base 40, and the outer periphery of the base 40 is provided with dimensional accuracy. The machining accuracy lies in the range of from ±0.1 mm to ±0.3 mm. The elastic layer 50 in the form of a sponge-like sheet is adhered to the outer periphery of the base 40 except for the recess 17 by two-sided adhesive tapes. Thereafter, the ball bearing 43 is press-fitted on the end of the shaft 11 protruding from the bottom wall 40*a* while the pulley 44 affixed to the same end.

Finally, the other ball bearing 43 is press-fitted on the end of the shaft 11 protruding from the flange 41.

The press drum 10 produced by the above procedure is mounted to the stencil printer. At this time, it is likely that the press drum 10 is hit against some object and has its surface damaged thereby. Assume the conventional press drum having a rubber layer on its outer periphery. Then, should any portion of the surface of the rubber layer be damaged, the damaged portion would disturb an image. In such a case, the rubber layer must be again ground and then vulcanized. This kind of scheme is costly and cannot easily repair the rubber layer. In the illustrative embodiment, the damaged press drum 10 can be repaired only if the elastic layer 50 is replaced.

Figure 9:
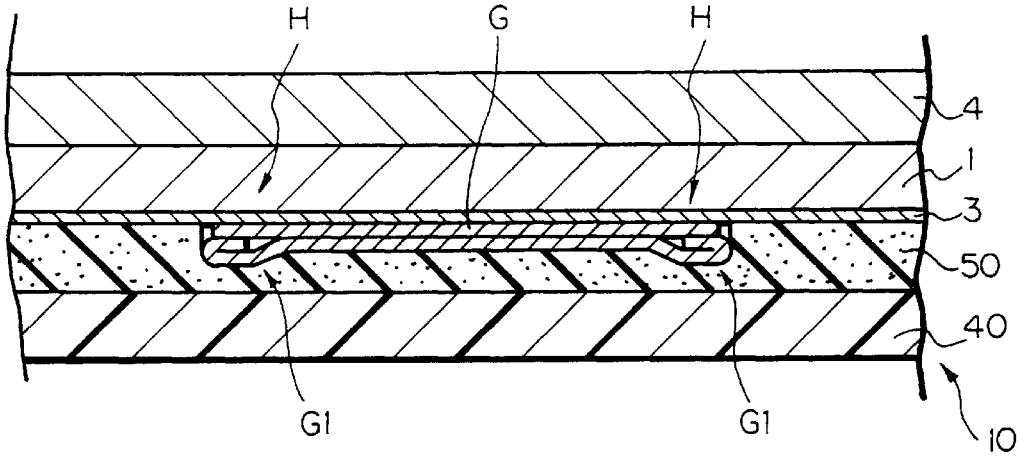
FIG. 9 is a fragmentary axial enlarged section showing a pressing position where the press drum of FIG. 5 and an ink drum are pressed against each other.

Assume that the stencil printer with the press drum 10 is operated to print an image on an envelope. As shown in FIG. 9, the press drum 10 is pressed against the ink drum 1 and has its elastic layer 50 compressed thereby. Particularly, the portion of the elastic layer 50 corresponding to an envelope G sinks complementarily to the configuration of the envelope G and is compressed by the volume of the envelope G. At this instant, the elastic layer 50 does not perform bulk movement, but performs elastic deformation. Specifically, urethane between the cells collapses and moves into the cells, absorbing the volume of the envelope G. Apparently, therefore, the urethane foam does not perform bulk movement.

While a pressing force acts on the envelope, the pressure acting on the folded portions G1 of the envelope is scattered by the cells of the elastic layer 50, i.e., prevented from concentrating on the folded portions G1. Consequently, the pressure acting on the portions (labeled H in FIG. 9) of the master 3 corresponding to the folded portions G1 is also reduced. It follows that even when images are printed on several hundred envelopes, the portions H of the master 3 are free from damage. In addition, the envelopes are free from contamination ascribable to the damage of the master 3.

Figure 10:
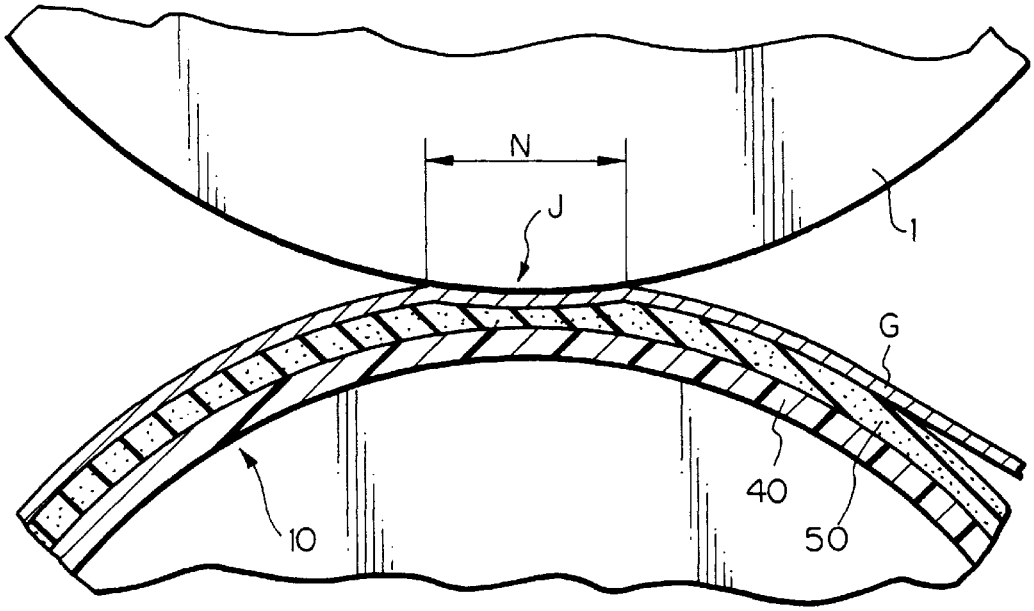
FIG. 10 is a fragmentary enlarged cross-section showing the pressing portion of FIG. 9.

The pressing force acting on the envelope G is scattered and absorbed by the compression of the elastic layer 50 and the cells of the layer 50. However, as shown in FIG. 10, a nip width N in a pressing position J is greater than the nip width of the conventional pressing position implemented by rubber. Consequently, the master 3 and envelope G contact each other over a longer period of time, preventing image density from decreasing. The absorption of the pressing force and not accompanying bulk movement can also be implemented if recesses or holes are formed in the rear of the conventional nitrile rubber (surface to be adhered to the cylindrical base of the press drum).

Figure 11:
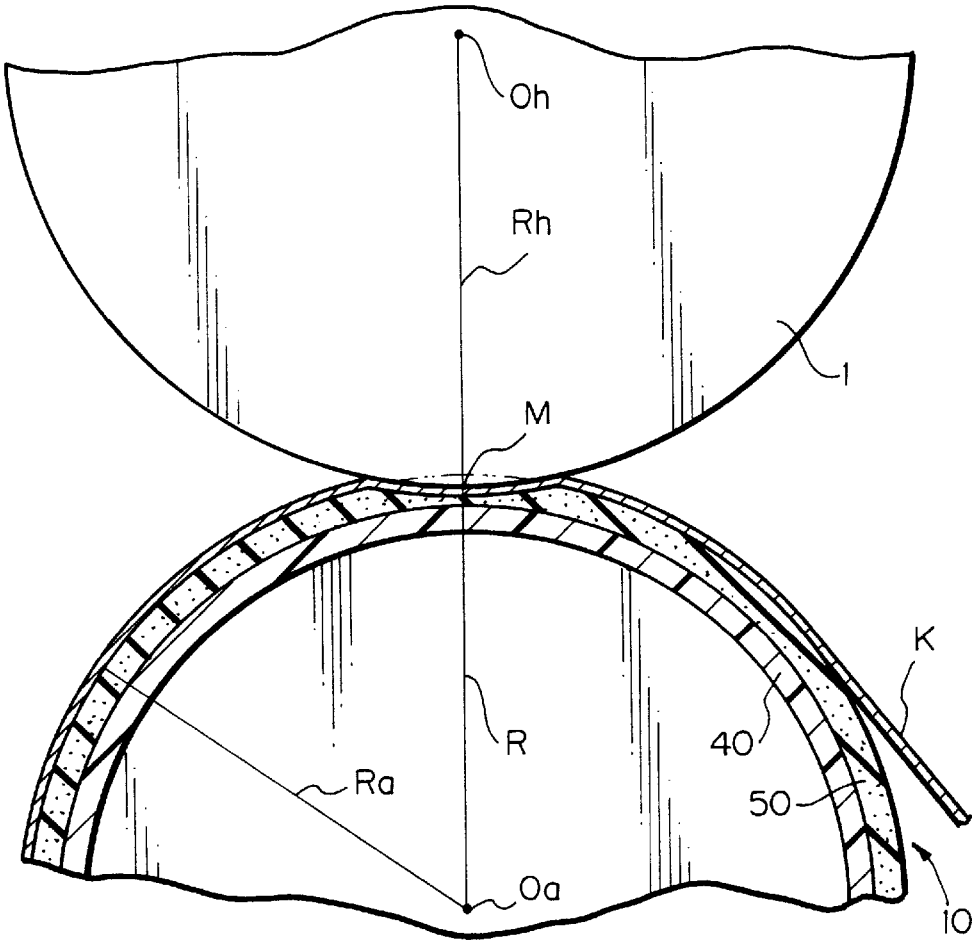
FIG. 11 is a fragmentary cross-section showing how the distance between the center of the ink drum and the pressing position and the distance between the center of the press drum and the pressing position vary.

As shown in FIG. 11, assume that an image is printed on a relatively thick paper K. Then, in a pressing position M, the elastic layer 50 is compressed by the paper K in the same manner as it is compressed by the envelope G. At the same time, the portion of the elastic layer 50 corresponding to the paper K is compressed by the volume of the paper K. In this case, too, the elastic layer 50 performs elastic deformation as distinguished from bulk movement. Assume that distance between the center Oa of the press drum 10 and the pressing position M is R, that the press drum 10 has a radius of Ra, and that the distance between the center Oh of the ink drum 1 and the pressing position M, i.e., the radius of the ink drum 1 is Rh. Then, when the elastic layer 50 is pressed and elastically deformed, the radius Ra of the press drum 10 becomes greater than the distance R. Because the diameter of the press drum 10 and that of the ink drum 1 are equal, Ra and Rh are equal. Therefore, in the pressed condition, Rh is greater than R. That is, the distance R does not exceed the radius Rh. Consequently, at the pressing position M, the linear velocity of the paper K does not exceed the linear velocity of the periphery of the ink drum 1. This successfully prevents the master 3 from creasing.

Even when the elastic layer 50 is implemented by a sponge-like sheet other than the POLON L-24 sheet, the master 3 can be prevented from creasing or being damaged. However, experimental results show that such an advantage is more noticeable with POLON L-24 than with the other sponge-like sheets.

In the above embodiment, the elastic layer 50 is implemented by a sponge-like sheet of urethane foam featuring a small residual compression strain. A sheet of non-adhesive microcell foam body mainly consisting of silicone rubber and featuring a small residual compression strain is comparable in advantage with POLON L-24. Specifically, such a non-adhesive foam material makes the surface of the elastic layer 50 non-adhesive and allows the paper to slip easily, thereby insuring the smooth feed of the paper to the paper clamper 19. The word "non-adhesive" refers to stickiness obstructing the slippage of the paper, i.e., great friction between the elastic layer 50 and the paper.

Figure 12:
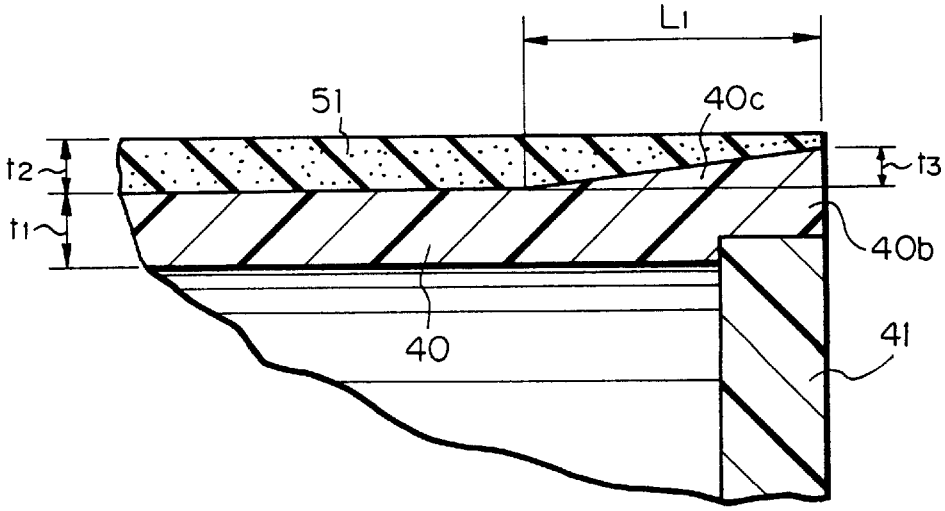
FIG. 12 is a fragmentary enlarged section showing a modification of the first embodiment.

In the illustrative embodiment, when the paper clamper 19 is opened, the opening degree is lower at the opposite ends of the press drum 10 than at the intermediate portion because the end portions are flared, as stated earlier. It is therefore difficult for the paper P to be inserted into the opening and clamped at the opposite ends of the paper clamper 19. As a result, the leading edge of the paper P is likely to bend at the time of clamping. FIG. 12 shows a modification of the above embodiment constructed to solve this problem.

As shown in FIG. 12, the elastic layer, labeled 51, has its end portion corresponding to the flared portion 40*c* sequentially reduced in thickness from the intermediate portion to the end. With this configuration, the elastic layer 51 has a smooth outer periphery free from irregularities. This is also successful to increase the hardness of the elastic layer 51 at opposite end portions when the layer 51 is to be pressed, and therefore to achieve the previously stated advantage. In addition, the opening degree of the paper clamper 19 is uniform over the entire axial length of the press drum 10, promoting the easy and sure clamping of the paper P. The dimensions t1, t2, t3 and L1 shown in FIG. 8 are identical with the specific dimensions shown in FIG. 8.

Figure 13:
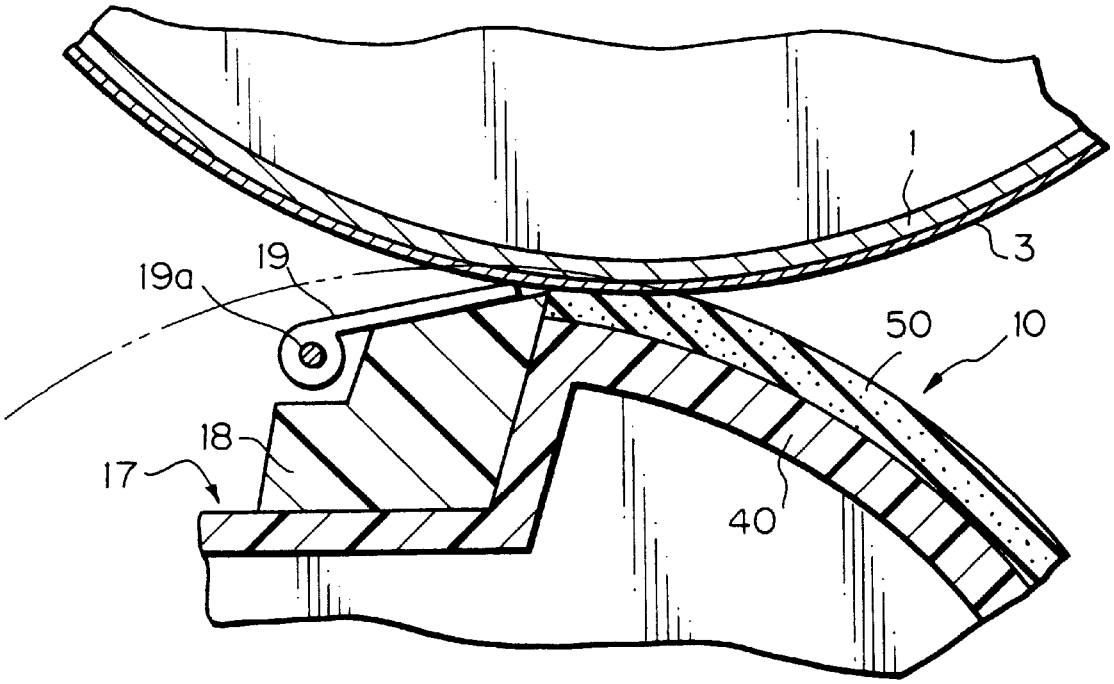
FIG. 13 is a fragmentary section demonstrating the deformation of an elastic layer included in the first embodiment.
Figure 14:
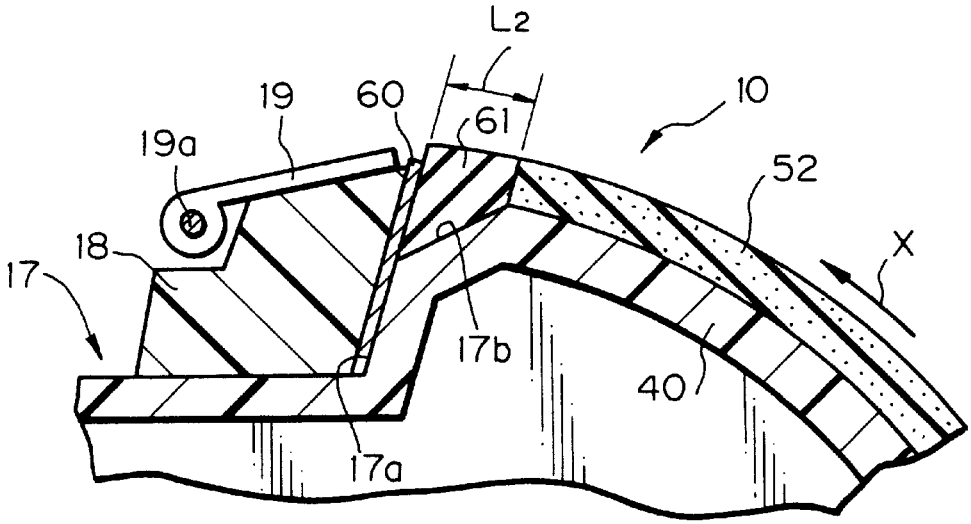
FIG. 14 is a fragmentary enlarged section showing a second embodiment of the present invention.

Reference will be made to FIG. 14 for describing a second embodiment of the present invention. In the first embodiment, when the press drum 10 is pressed against the ink drum 1 during printing, the portion of the elastic layer 50 contacting the drum 1 first is subjected to an intense pressing force. As a result, the elastic layer 50 is partly heavily compressed. It is therefore likely that, as shown in FIG. 13, the edge of the paper clamper 19 contacts and damages the master 3 wrapped around the ink drum 1. The second embodiment is a solution to this problem.

As shown in FIG. 14, when the press drum 10 is pressed against the ink drum 1, the stepped portion of the recess 17 positioned at the upstream side in the direction of rotation X of the drum 10, i.e., at the side where the clamper base 18 is located contacts the drum 1 first. This stepped portion includes a slant 17*b* inclined downward toward the clamper base 18. A flat bracket 60 elongate in the axial direction of the press drum 10 is affixed to the edge 17*a* of the recess 17 by screws not shown. The bracket 60 and slant 17*b* form a wedge-shaped space therebetween. A rubber layer 61 is received in the wedge-shaped space for reducing an impact to occur when the press drum 10 is caused to contact the drum 1. The rubber layer 61 is formed of nitrile rubber and molded by vulcanization complementarily to the above space. The side of the rubber layer 61 opposite to the wedge-shaped side and forming a part of the outer periphery of the press drum 10 is contiguous with the surface of the elastic layer 52. The rubber layer 61 is affixed to the slant 17*b* and bracket 60 by adhesive.

The rubber layer 61 and an elastic layer 52 are affixed to each other by adhesive not shown. A thin film is adhered to the contiguous outer periphery of the rubber layer 61 and elastic layer 52 for preventing the ink from penetrating into the elastic layer 52. The rubber layer 61 has a length L2, as measured in the direction X, which should only cover the contact portion. In the illustrative embodiment, the length L2 is selected to be 5 mm to 10 mm. In this condition, when the press roller 10 is pressed against the ink drum 1, the rubber layer 61 contacts the drum 1 first. This reduces the deformation of the outer periphery of the press drum 10 and thereby prevents the edge of the paper clamper 19 from contacting the master 3 wrapped around the ink drum 1. In addition, the rubber layer 61 reduces an impact and therefore noise ascribable to the contact.

Figure 15:
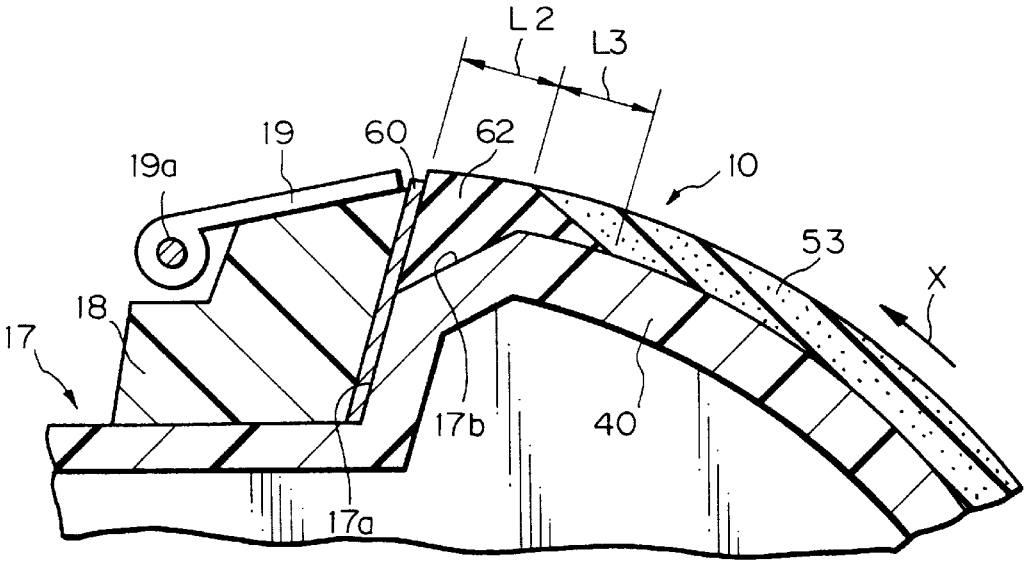
FIG. 15 is a fragmentary enlarged section showing a modification of the second embodiment.

FIG. 15 shows a modification of the second embodiment. In the second embodiment, hardness sharply changes at the boundary between the rubber layer 61 and the elastic layer 53, tending to effect image density in the case of a halftone image. In the modification shown in FIG. 15, at the above boundary, the end portion of the rubber layer 62 is sequentially reduced in thickness from the downstream side to the upstream side in the direction X. Also, the end portion of the elastic layer 53 is sequentially increased in thickness from the downstream side to the upstream side. The portion where the thickness of the rubber layer 62 and that of the elastic layer 53 so vary has a length L3 equal to the length L2, i.e., 5 mm to 10 mm.

In the above modification, hardness varies little by little at the boundary between the rubber layer 62 and the elastic layer 53, i.e., decreases little by little from the rubber layer side to the elastic layer side. Such a hardness distribution obviates irregular density even when a halftone image is printed. By increasing the length L3 it is possible to vary hardness more smoothly at the above boundary.

Now, in the stencil printer, the leading edge of the paper P is conveyed toward the paper clamper 19 while sliding on the outer periphery of the press drum 10, i.e., the outer periphery of the elastic layer 50. At this instant, cells present on the outer periphery of the elastic layer 50 are apt to catch the leading edge of the paper P and make it difficult for the leading edge to be accurately clamped by the paper clamper 19. Further, should the press drum 10 be pressed against the ink drum 1 in the absence of the paper P due to, e.g., a jam, the ink would be transferred to the elastic layer 50 and would thereby smear the rear of the paper P at the time of printing effected later. Moreover, the ink deposited on the elastic layer 50 would penetrate into the cells to thereby aggravate the residual compression strain. A third embodiment capable of solving these problems will be described with reference to FIG. 16. Because the third embodiment is substantially similar in configuration to the first embodiment, identical structural elements are designated by identical references and will not be described specifically in order to avoid redundancy.

Figure 16:
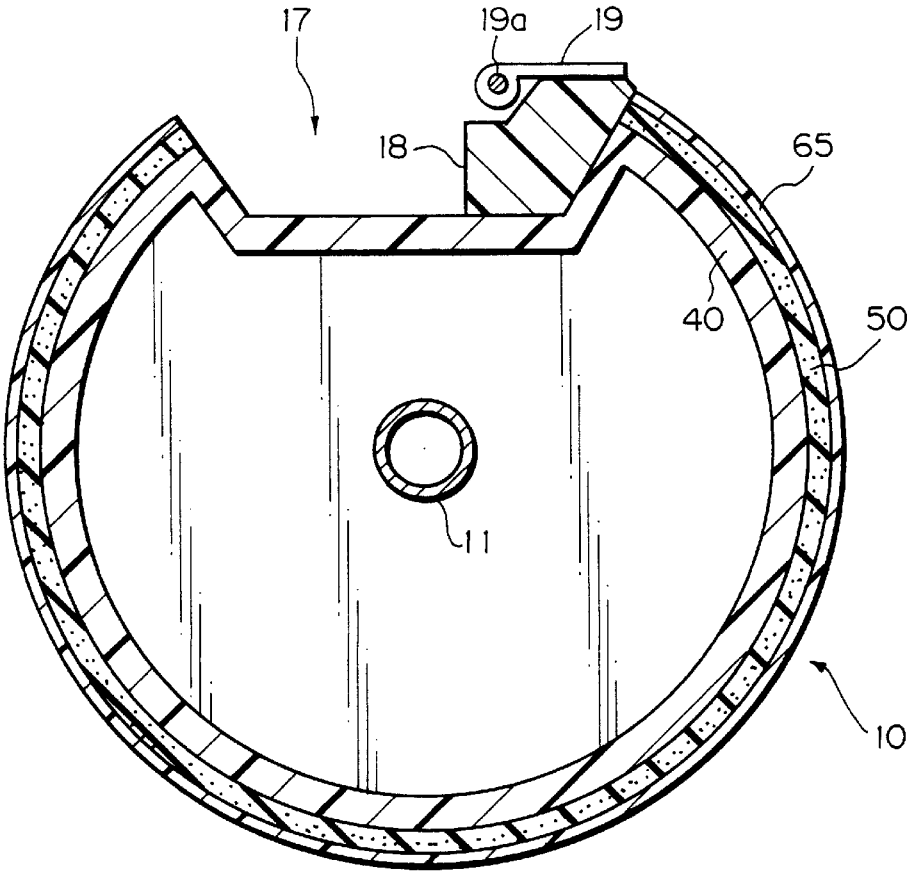
FIG. 16 is a cross-section showing a third embodiment of the present invention.

As shown in FIG. 16, a polyester film 65 implemented by polyethylene terephthalate resin is wrapped around the elastic layer 50 and adhered to the layer 50 by conventional adhesive. Because the polyester film 65 has inherently low flexibility, increasing the thickness of the film 65 would lower its elasticity and would thereby render it little deformable. If the press drum 10 with such a polyester film 65 were used to print images on, e.g., postcards or envelopes, the film 65 would obstruct the elastic deformation of the elastic layer 50 and would thereby tear the master 3. This is presumably because the polyester film 65 does not deform like the elastic layer 50 in the event of printing effected with postcards or envelopes. For this reason, the thickness of the polyester film 65 should be limited. Experiments showed that the adequate thickness of the polyester film 65 is 10 $\mu$m to 50 $\mu$m. With this range of thickness, the film 65 does not lower the elasticity of the elastic layer 50.

The polyester film 65 may be replaced with a thermoplastic polyurethane elastomer film, e.g., SILKLON ES85 available from Okura Industrial Co., Ltd. This kind of film is so flexible, it is as elastic as the elastic layer 50 even when increased in thickness. The alternative film also prevents the master 3 from being torn off in the event of printing effected with postcards or envelopes, as determined by experiments.

It will be seen that the polyester film 65 renders the outer periphery of the press drum 10 less frictional and non-adhesive and thereby insures the conveyance of the paper P. Further, the film 65 prevents the ink from depositing on the elastic layer 50 or penetrating into the elastic layer 50. Moreover, the transfer of the ink to the rear of the paper P is obviated. In addition, the ink, if deposited on the elastic layer 50, can be wiped off with ease.

If desired, the polyester film 65 may be adhered to the outer periphery of the elastic layer 50 by two-sided adhesive tapes. Only the film 65 can be replaced if the adhesive tapes is provided with a relatively weak adhesive force.

Figure 17:
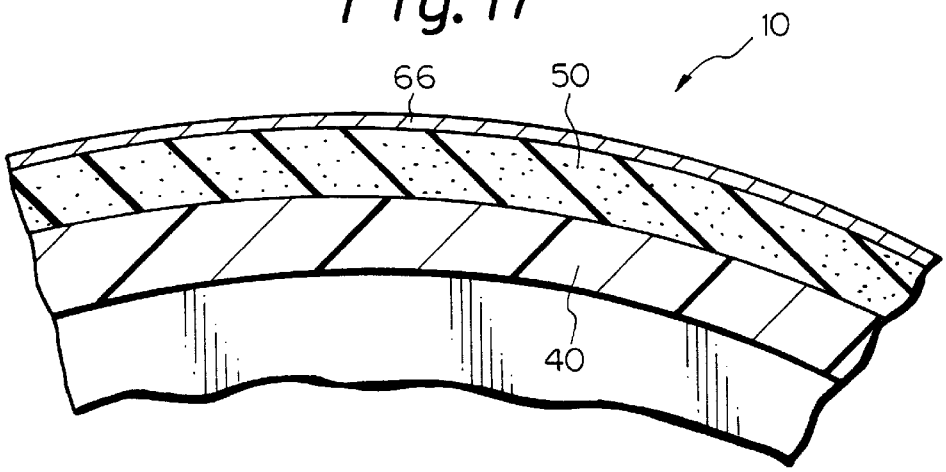
FIG. 17 is a fragmentary enlarged section showing a fourth embodiment of the present invention.

FIG. 17 shows a fourth embodiment of the present invention. As shown, a surface treatment layer 66 is formed on the surface of the elastic layer 50. To form the surface treatment layer 66, a TEFLON film treated at low temperature is applied to the surface of the elastic layer 50. The surface treatment layer 66 prevents the cells of the elastic layer 50 from contacting the paper P and thereby reduces the coefficient of friction, i.e., increases the smoothness of the outer periphery of the press drum 10. This configuration achieves the same advantages as stated in relation to the third embodiment.

The polyester film 65 or the surface treatment layer 66 is also applicable to the press drum 10 of the second embodiment. In the first to fourth embodiments, the press drum 10 is implemented by a cup-like hollow cylinder and a disk-like flange affixed to the open end of the cylinder. Alternatively, a pair of disk-like flanges may be affixed to both ends of a hollow cylinder.

In summary, it will be seen that the present invention provides a press drum for a stencil printer having various unprecedented advantages, as enumerated below.

(1) At the time of printing, the entire elastic layer is compressed. At the same time, the portion of the elastic layer corresponding to a recording medium is compressed by the volume of the recording medium, so that the elastic layer performs elastic deformation in place of bulk movement. This protects a master from damage and creasing ascribable to the localization of a pressing force.

(2) Pressing forces acting on the folded portions of a recording medium are scattered by the elastic layer and prevented from concentrating on the folded portions. As a result, the pressing forces are prevented from concentrating on and damaging the portions of the master corresponding to the folded portions. In addition, there can be obviated the contamination of the recording medium ascribable to the damage of the master.

(3) Because the specific gravity of the elastic layer is smaller than the specific gravity of rubber, the overall weight of the press drum is reduced.

(4) The surface of the elastic layer is non-adhesive and allows the recording medium to smoothly slide thereon, so that the recording medium can be surely conveyed.

(5) The press drum has higher hardness at its opposite end portions than at its intermediate portion. Therefore, when the press drum is pressed against an ink drum, a desired printing pressure is guaranteed over the entire area of an image and obviates the blurring and local omission of an image. Particularly, at the time of low temperature printing or high speed printing, an image is free from blurring and local omission ascribable to the short rigidity of the opposite end portions of the press drum.

(6) When the press drum is brought into contact with the ink drum, a rubber layer contacts the ink drum first and thereby reduces the deformation of the outer periphery of the press drum. This prevents the edge of a paper clamper from contacting and damaging the master wrapped around the ink drum. In addition, the rubber layer reduces an impact and therefore noise ascribable to the pressing force.

(7) The outer periphery of the press drum is rendered less frictional and non-adhesive, insuring the conveyance of the paper. Further, the ink is prevented from depositing on the elastic layer or penetrating into the elastic layer to aggravate residual compression strain. Moreover, the transfer of the ink to the rear of the paper is obviated. In addition, the ink, if deposited on the elastic layer, can be wiped off with ease.

(8) Because a hollow cylinder is implemented as a single molding of thermosetting synthetic resin, it does not need any rib thereinside. The press drum is therefore smaller in weight and greater in rigidity than the conventional aluminum molding. Further, the hollow cylinder achieves enhanced strength because it has a cup-like configuration whose open end is closed by a flange.

(9) Urethane foam constituting the elastic layer has independent cells and prevents the ink from penetrating into the elastic layer even when the ink is deposited on the elastic layer.

(10) Hardness varies little by little at the boundary between the rubber layer and the elastic layer, i.e., decreases little by little from the rubber layer side to the elastic layer side. Therefore, even a halftone image is free from irregular density.

(11) A microcell foam material has a smooth surface and can press a recording medium evenly. This also frees images from irregular density.

Various modifications will become possible for those skilled in the art after receiving the teachings of the present disclosure without departing from the scope thereof.

What is claimed is:

1. A stencil printing press drum for printing on a paper recording medium, comprising:

a rotatable hollow cylinder configured to produce a pressing force which presses the paper recording medium against a rotatable ink drum having a master wrapped therearound; and, elastic means for elastically absorbing said pressing force in place of bulk movement when compressed, said elastic means formed on an outer periphery of said hollow cylinder.

2. A press drum as claimed in claim 1, wherein said elastic means comprises a sheet of urethane foam whose residual compression strain is below ten percent.

3. A press drum as claimed in claim 2, wherein the urethane foam comprises a microcell foam material having a number of independent cells.

4. A press drum as claimed in claim 3, wherein the microcell foam material has a smooth surface.

5. A press drum as claimed in claim 1, wherein said elastic means comprises a sheet of non-adhesive silicone rubber.

6. A press drum as claimed in claim 1, wherein said hollow cylinder comprises opposite end portions of outer periphery, each opposite end portion sequentially increases in outside diameter from an intermediate portion of said cylinder to an end of said cylinder, and said elastic means sequentially decreases in thickness from said intermediate portion to said end such that said opposite end portions of said hollow cylinder have a same diameter as said intermediate portion.

7. A press drum as claimed in claim 1, wherein said elastic means includes a rubber layer configured to reduce an impact ascribable to contact of the outer periphery of said press drum with said ink drum where said elastic layer would contact the ink drum first.

8. A press drum as claimed in claim 7, wherein a part of said rubber layer located at an upstream side in a direction of rotation of said press drum sequentially deceases in thickness from a downstream side in said direction to the upstream side and a part of said elastic means corresponding to said part of said rubber layer sequentially increases in thickness from said downstream side to said upstream side.

9. A press drum as claimed in claim 1, further comprising a surface treatment layer formed on an outer periphery of said elastic means and configured to reduce a coefficient of friction of said outer periphery and to render said outer periphery non-adhesive.

10. A press drum as claimed in claim 1, further comprising a sheet in a form of a synthetic resin film which is wrapped around said elastic means.

11. A press drum as claimed in claim 1, wherein said hollow cylinder includes a bottomed cupped configuration whose open end is closed by a flange, said hollow cylinder and said flange being formed of thermosetting synthetic resin.

12. A stencil printing press drum for printing on a paper recording medium, comprising:

a rotatable hollow cylinder configured to produce a pressing force which presses the paper recording medium against a rotatable ink drum having a master wrapped therearound; and, an elastic layer formed on an outer periphery of said hollow cylinder, comprising a sheet of urethane foam including a microcell foam material having a plurality of independent cells configured to absorb said pressing force in place of bulk movement when compressed.

* * * * *

UNITED STATES PATENT AND TRADEMARK OFFICE

CERTIFICATE OF CORRECTION

PATENT NO. : 6,101,935

DATED : August 15, 2000

INVENTOR(S) : EIJI OHKAWA

It is certified that error appears in the above-identified patent and that said Letters Patent is hereby corrected as shown below:

Title Page, insert "for" after "drum" and before "a".
Column 5, line 57, change "damper" to --clamper--.

Signed and Sealed this

Eighth Day of May, 2001

*Attest:*

Nicholas P. Godici

NICHOLAS P. GODICI

*Attesting Officer*

*Acting Director of the United States Patent and Trademark Office*